United States Patent [19]

Wenzel et al.

[11] Patent Number: 5,025,759

[45] Date of Patent: Jun. 25, 1991

[54] LEVER-TYPE TWO-CYCLE INTERNAL COMBUSTION ENGINE

[76] Inventors: Edward C. Wenzel; Steven T. Wenzel, both of P.O. Box 213, Allamuchy, N.J. 07820

[21] Appl. No.: 510,428

[22] Filed: Apr. 18, 1990

[51] Int. Cl.[5] ..... F01B 1/08

[52] U.S. Cl. ..... 123/56 AC; 123/56 BC; 123/197 AC

[58] Field of Search ..... 123/56 AC, 56 BC, 197 AC, 123/192 R

[56] References Cited

U.S. PATENT DOCUMENTS

| | | | |
|---|---|---|---|
| 1,097,725 | 5/1914 | McKiearnan | 123/197 AC |
| 3,608,530 | 9/1971 | Wenzel | 123/56 BC |
| 4,470,387 | 9/1984 | Gonska | 123/192 R |
| 4,538,557 | 9/1985 | Kleiner et al. | 123/197 AC |
| 4,917,066 | 4/1990 | Freudenstein et al. | 123/197 AC |

FOREIGN PATENT DOCUMENTS

| | | | |
|---|---|---|---|
| 0354781 | 8/1931 | United Kingdom | 123/56 AC |

*Primary Examiner*—Willis R. Wolfe
*Assistant Examiner*—Tom Moulis
*Attorney, Agent, or Firm*—Brumbaugh, Graves, Dononhue & Raymond

[57] ABSTRACT

An internal combustion engine having paired opposed power cylinders, and a lever system interconnecting the pistons of the opposed power cylinders with each other and with a crankshaft. The lever system for each pair of cylinders includes the piston rods of the two pistons, each being pivotally connected at one end to its respective piston and being pivotally connected together at their opposite ends and also to one end of a lever arm. The lever arm is connected intermediate its ends to the crankshaft, and its other end is guided to follow a linear path and acts as a moveable fulcrum for the lever system. A compressor driven in rotation by the crankshaft supplies air to the cylinders.

9 Claims, 3 Drawing Sheets

FIG. 4.
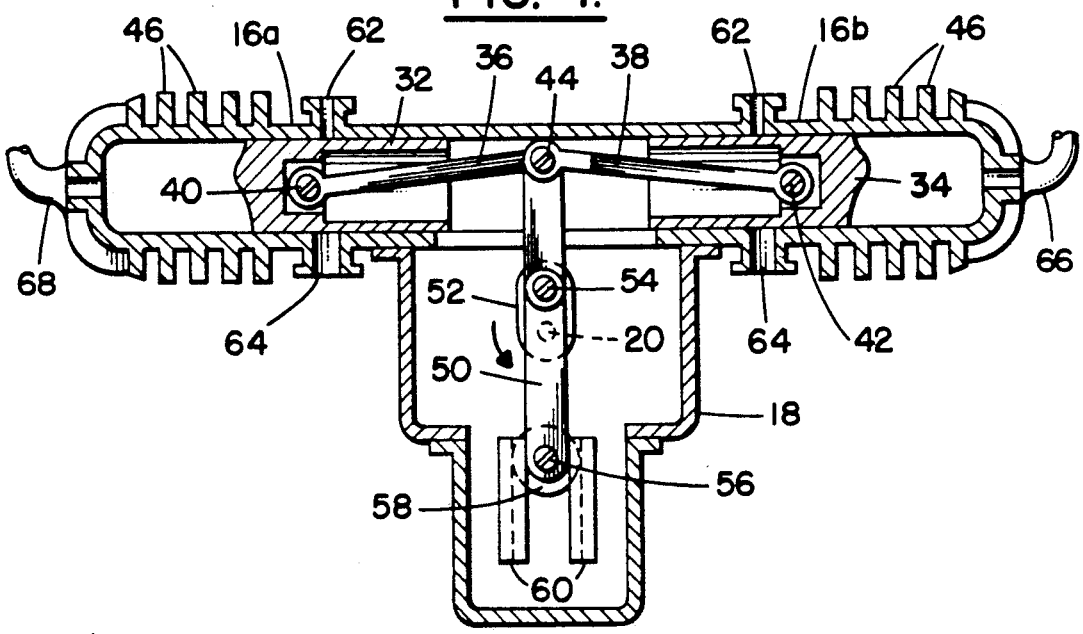
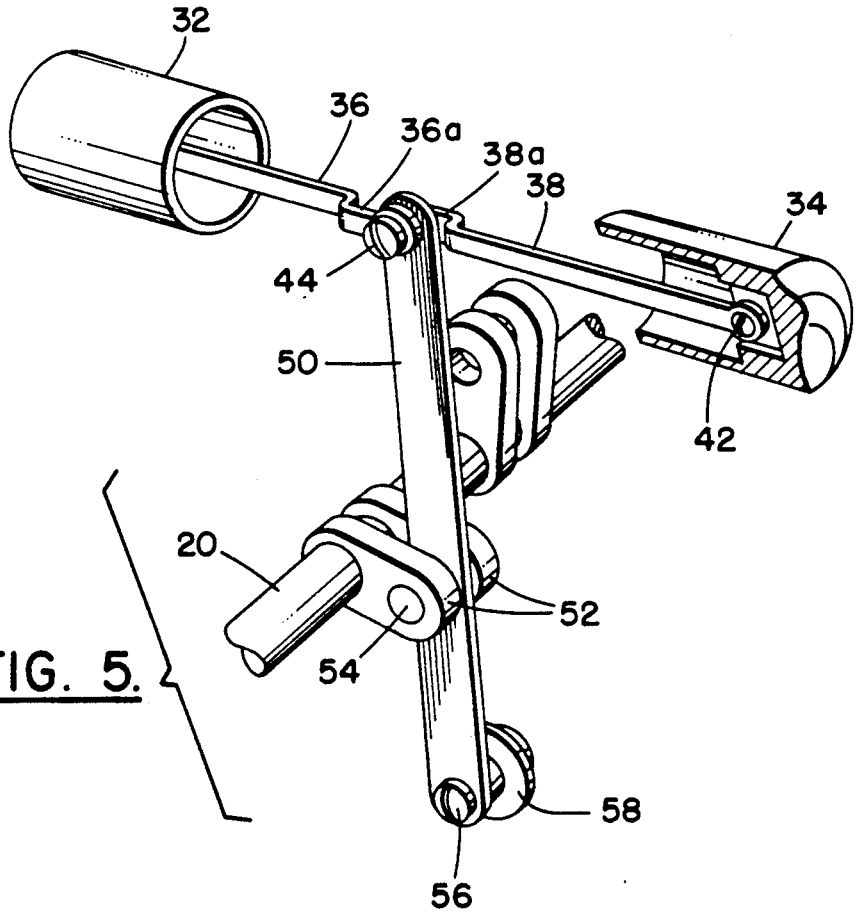
FIG. 5.

LEVER-TYPE TWO-CYCLE INTERNAL COMBUSTION ENGINE

BACKGROUND OF THE INVENTION

This invention relates to two-cycle internal combustion engines of the lever type and, more particularly, to improvements to two-cycle internal combustion engines of the kind described in U.S. Pat. No. 3,608,530 issued on Sept. 28, 1971 to one of the present applicants.

In general, two-cycle engines of the lever type have opposed power cylinders and separate air or air-fuel charging cylinders and a lever system interconnecting the power and charging cylinder pistons with each other and with a crank shaft. In the engine described in the patent, the disclosure of which is hereby incorporated herein by reference, a plurality of power cylinders (preferably in multiples of four or eight) are so arranged in pairs that the cylinders of each pair are directly opposed in axially aligned relationship in a horizontal plane; in the eight-cylinder engine, four pairs of opposed cylinders are arranged in parallel side-by-side relationship in a common horizontal plane. A single charging cylinder is provided for each pair of opposed power cylinders and are arranged in parallel side-by-side relationship in a common vertical plane, with the axes of the charging cylinders extending vertically and intercepting the axes of the power cylinders at right angles. The piston rod of each charging cylinder is connected at its lower end to the connected outer ends of the piston rods of the horizontally opposed power cylinders. That is, the inner end of each of the three piston rods is pivotally connected to its respective piston and the outer end of each piston rod is pivotally connected to the corresponding outer ends of the other two piston rods.

The crankshaft of the engine is located above the horizontally opposed power cylinders and below the vertically extending charging cylinders. The piston rod of the charging cylinder is connected, at a point intermediate its ends, to an offset crank pin of the crankshaft, and functions as the operative lever of the lever system. In this arrangement, the inner end of the lever (connected to the piston rod of the charging cylinder) is its fulcrum end; the outer end of the lever (which is connected to the outer ends of the piston rods of the power cylinders) is its effort end; and the intermediate connection between the lever and the crankshaft is the load or work-applying portion of the lever. There is no fixed axis for any part of the lever: the fulcrum moves linearly in a vertical line, reciprocating between upper and lower positions; the load-applying portion rotates in a circular path about the axis of the crankshaft; and the effort end of the lever describes an orbital path. The axial alignment of the opposed power cylinders provides a direct thrust, inertia absorbing cushion in each cylinder of each pair of opposed cylinders so as to free the crankshaft from excess inertial loading and making feasible a stroke-to-bore ratio in the power cylinders as high as approximately 2:1.

While the feature of interposing a lever between the power pistons and the crankshaft is essential to achievement of a 2:1 stroke-to-bore ratio so as to make possible a high torque, low speed engine in a small package, the structure illustrated in the patent has a number of undesirable mechanical features which have not heretofore been successfully overcome. For example, the high profile of the vertically-oriented charging cylinders makes the engine relatively large, and the friction of the charging pistons, which are connected to the moveable fulcrum, placed an undesirably heavy load on the crankshaft, with resulting decrease in engine efficiency. The vertical orientation of the charging cylinders, together with their position above the crankshaft, makes it difficult to properly lubricate the charging cylinder pistons.

Also, due to the orientation of the charging cylinders relative to the power cylinders, the outer end of the piston rod of each of the opposed power cylinders and also the outer end of the piston rod of the associated charging cylinder are pivotably connected along the common axis of a connecting pin passing through aligned holes near the ends of each of the three piston rods, with the result that their other ends (i.e., the end connected to a piston) do not lie in the vertical plane defined by the central axes of the three cylinders. As a consequence, at least two the piston rods are necessarily bent along some portion of their length, thus requiring that forces other than compression and tension must be taken into account in the design of the piston rods.

A primary object of the present invention is to provide an improved lever-type engine which avoids the above-outlined undesirable features of the engine described in the aforementioned patent.

Another object of the invention is to provide a lever-type engine of the character described, wherein opposed power cylinders are axially aligned to provide a direct thrust and are supplied with air from a compressor driven in rotation by the crankshaft, thereby to eliminate the troublesome charging cylinders of the prior art engine.

Another object is to provide a lever-type engine of the character described, wherein the power cylinders are arranged in a horizontal plane disposed above the crankshaft and which takes advantage of the slidable fulcrum principle with a simple, relatively short connecting linkage between the power pistons and the crankshaft.

SUMMARY OF THE INVENTION

The lever engine according to the invention has a plurality of power cylinders (preferably in multiples of four or eight) arranged in pairs in such a manner that the cylinders of each pair are directly opposed in coaxial relationship in a horizontal plane. In an eight-cylinder diesel engine as herein shown and described, there are four pairs of opposed cylinders arranged in parallel side-by-side relationship in a common horizontal plane. Air is supplied to all of the power cylinders by a compressor mounted on and driven in rotation by the engine crankshaft. The crankshaft extends horizontally with its axis disposed in a horizontal plane located below the horizontal plane occupied by the opposed power cylinders. The crankshaft has four crank arms equally angularly spaced from each other at 90° intervals, there being one crank arm for each pair of opposed cylinders. At least two power cylinders deliver power to the crankshaft at all times. The compressor supplies air to all of the power cylinders all of the time, with air entering selected power cylinders only when their respective inlet ports are opened at the end of a power stroke.

The lever mechanism of each pair of opposed power cylinders comprises an elongate lever arm which is pivotally connected at its upper end to the outer ends of the piston rods of the two cylinders, is pivotally connected at a point intermediate its ends to a respective arm of the crankshaft, and is constrained at its lower end to move up and down along a vertical line as the crankshaft is rotated. Thus, the lever arm may be considered to be the operative lever of the lever mechanism, its constrained end is its moveable fulcrum and describes a linear path, the intermediate connection between the lever arm and the crankshaft is the work-applying portion of the lever and rotates in a circular path about the axis of the crankshaft, and the end pivotally connected to the piston rods of the power cylinders is its effort end and describes an orbital path.

Other objects, features and advantages of the invention, and a better understanding of its construction and operation, will be had from the following detailed description, taken in conjunction with the accompanying drawings.

BRIEF DESCRIPTION OF THE DRAWINGS

FIG. 4 is a third vertical cross-section similar to FIGS. 2 and 3 showing the opposed pistons in a third position; and FIG. 5 is a fragmentary perspective view showing the construction of the lever mechanism.

DESCRIPTION OF THE PREFERRED EMBODIMENT

Figure 1:
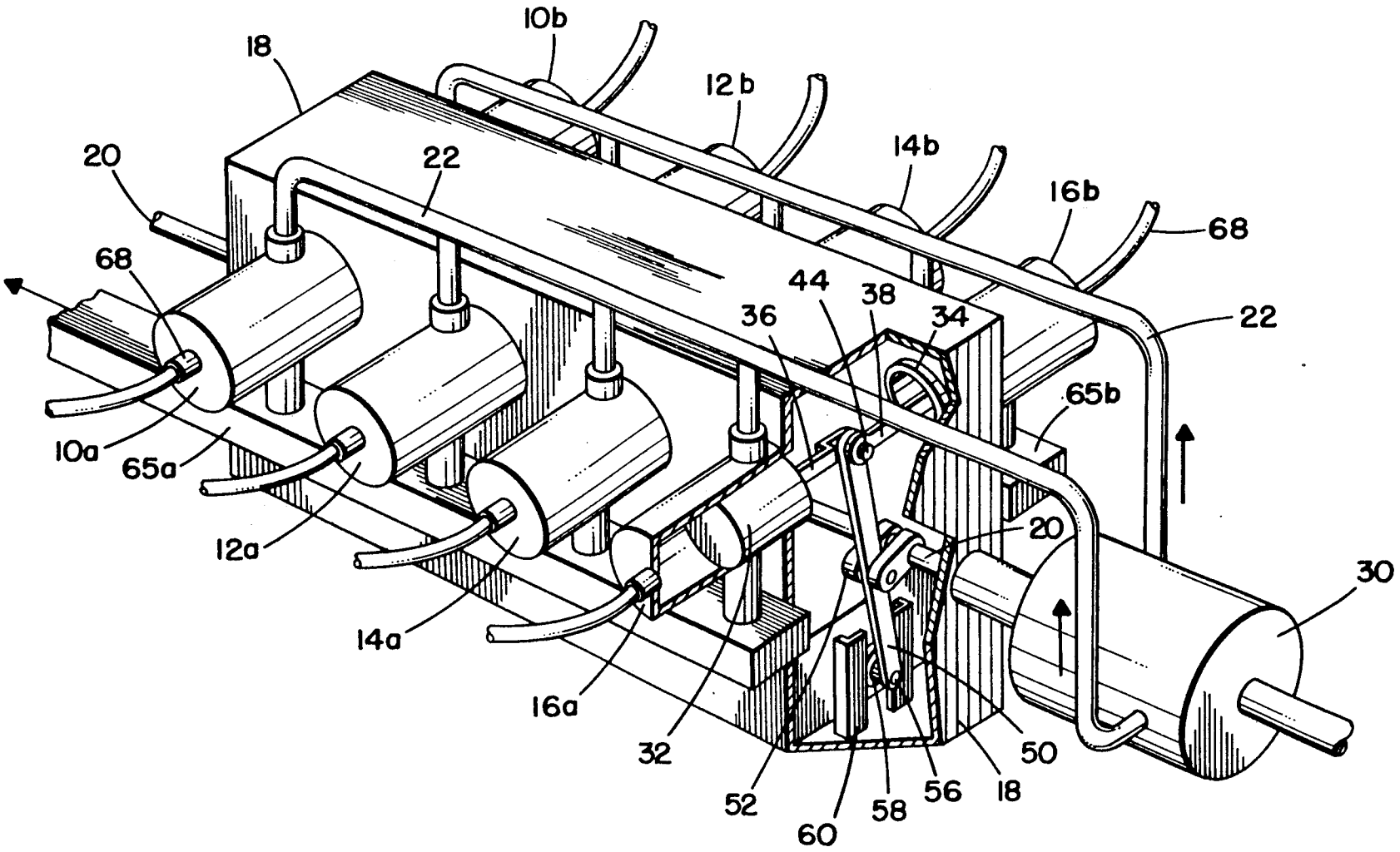
FIG. 1 is a perspective view, partially cut away, of an eight-cylinder, two-cycle diesel engine constructed in accordance with the principles of this invention.

Referring to the drawings, the engine according to the invention, illustrated as being of the diesel type, has four pairs of power cylinders, eight in all, respectively designated as 10*a* and 10*b*, 12*a* and 12*b*, 14*a* and 14*b*, and 16*a* and 16*b*. An elongated housing 18 supports the four pairs of power cylinders in a common horizontal plane in side-by-side relationship so that the longitudinal axis of each pair is parallel to the longitudinal axes of the other three pairs. A crankshaft 20 is supported with in housing 18, there being only one crankshaft for the eight power cylinders.

Air under pressure is supplied to power cylinders 10*a*, 12*a*, 14*a* and 16*a* via an air manifold 22*a* and to power cylinders 10*b*, 12*b*, 14*b* and 16*b* via a second manifold 22*b* by a suitable compressor 30 mounted on and driven in rotation by the engine crankshaft. The compressor may take the form of a two-stage compressor capable of displacing a volume of air necessary to support combustion in the eight cylinders, which may be of the order of 200 cubic inches in an engine of typical size, with the output of each stage coupled to a respective manifold.

Each power cylinder is provided with a piston and a piston rod; the construction of all pairs being the same except for the angle of their associated crank arm of the crankshaft at any particular moment, it will suffice to describe the details of only the pair 16*a*, 16*b* shown in perspective in FIG. 1. More specifically, and with reference to FIG. 2, cylinders 16*a* and 16*b* are respectively provided with pistons 32 and 34, the cylinders being long in relation to their diameter; that is, the length of the stroke of each piston exceeds its diameter. The piston rods 36 and 38 of power cylinders 32 and 34, respectively, are pivotally connected at their inner ends to their respective pistons by means of crosspins 40 and 42, respectively, and their outer ends are pivotally connected to each other and to one end of an elongate lever arm 50 by means of a crosspin 44.

As best seen in FIG. 5, the lever arm 50 is also pivotally connected to an associated crank 52 of crankshaft 20 by a crank pin 54. Secured at the lower end of lever arm 50, as by a crosspin 56, is a rotatable disk 58 dimensioned to be engaged between and guided by a pair of spaced, vertically oriented guides 60 supported within the housing 18 to move up and down along a vertical line. The crankshaft 20 is, of course, adequately supported in the housing by bearings in any conventional manner. In order to avoid bending of piston rods 36 and 38 as their respective pistons are driven back and forth in unison, their outer ends are offset at 36*a* and 38*a*, respectively, by approximately one-half the thickness of lever arm 50, such that the two piston rods and the lever arm are always disposed in a common vertical plane regardless of the positions of the cylinders.

The invention is primarily applicable to two-cycle internal combustion engine, and as has been indicated the drawings illustrate the application of the invention to a two-cycle diesel engine. The power cylinders have no valve system other than open inlet and exhaust ports formed in the cylinders and the pistons themselves, which open and close the ports at appropriate times. Specifically, each cylinder is provided with an inlet port 62 and an outlet or exhaust port 64. As described earlier, the inlet ports of two groups of four cylinders are connected via respective manifolds to the compressor 30. The outlet or exhaust ports of the two groups are connected to respective exhaust manifolds 65*a* and 65*b* and to an exhaust pipe which is not shown in the drawing because it is entirely conventional.

The inlet ports 62 are of smaller diameter than the exhaust ports 64, and preferably are not coaxial; however, they do register with each other to the extent of the diameter of the inlet ports. When a piston reaches its extreme outermost position relative to the cylinder in which it is housed, for example, the position of piston 32 in FIG. 2, both ports 62 and 64 of cylinder 16*a* are fully open. When the piston occupies a less extreme outer position, as does piston 32 in cylinder 16*a* in FIG. 3, inlet port 62 is closed while output port 64 is partly opened and partly closed. When pistons 32 and 34 are both at an intermediate position in its respective cylinder, as shown in FIG. 4, both ports 62 and 64, in both cylinders, are closed. Depending upon the direction of movement of the piston relative to these two ports, outlet port 64 may first open and then inlet port 62, or inlet port 62 may first close and then exhaust port 64.

The significance of this opening and closing sequence is as follows: when a piston, for example, piston 32, moves outwardly in its power stroke, outlet port 64 first opens to allow the combustion gases to escape. This occurs immediately before the piston reaches its outermost position relative to the cylinder; by the time the outermost position is reached, the inlet port also opens, enabling an inward rush of air to scavenge the cylinder and thereby drive the remaining combustion gases out of the cylinder through exhaust port 64. The combustion gases are thereby replaced by a fresh charge of air, and when the piston reverses its stroke and moves inwardly relative to its cylinder, inlet port 62 closes, thereby shutting off the supply of air from the compressor. Further inward movement of the piston closes the outlet port, and the fresh charge of air may now be compressed. In a diesel engine, fuel is injected into the power cylinders by means of fuel injectors 68 and the compressed air-fuel mixture is ignited by heat of compression.

The mechanical operations of a representative pair of power cylinders will now be described with reference to FIGS. 2, 3 and 4, which depict the positions of pistons 32 and 34 in cylinder 16*a* and 16*b* at various stages in a cycle. In all of these figures the crankshaft 20 rotates in a counterclockwise direction, as indicated by curved arrow 66. Starting with FIG. 2, piston 32 is at is extreme outer position following a power stroke and piston 34 is at its innermost position following a compression stroke. Ports 62 and 64 in cylinder 16*a* are open to allow combustion gases to escape through the outlet 64 and a fresh charge of air to enter through inlet port 62. The inrush of fresh air completes the evacuation of combustion gases and fills the cylinder. At the same time, the air-fuel mixture within cylinder 16*b* is compressed preparatory to a power stroke of piston 34. Ignition occurs by heat of compression and explosion takes place within cylinder 16*b*.

For this pair of opposed cylinders the associated crank arm 52 of the crankshaft 20 is disposed horizontally, in which position the distance between pivot pins 54 and 44 is such that piston rods 36 and 38 are substantially colinear and the disk 58 assumes a position approximately midway between the ends of vertical guides 60.

Figure 2:
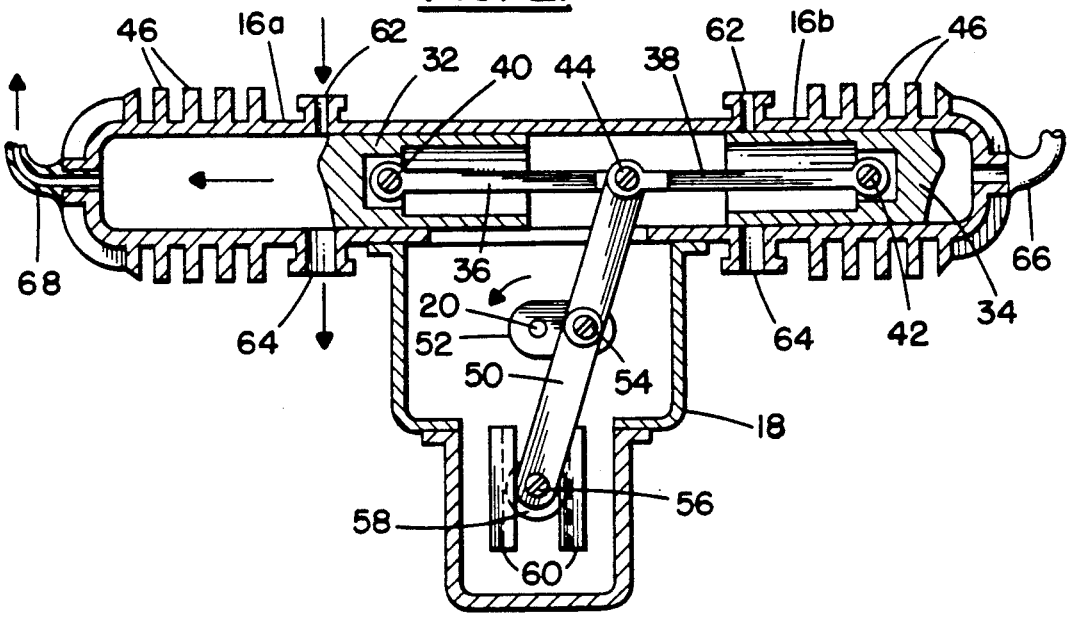
FIG. 2 is a cross-section along a vertical plane perpendicular to the axis of the crankshaft and which bisects a pair of opposed power cylinders and shows the pistons in a first position.
Figure 3:
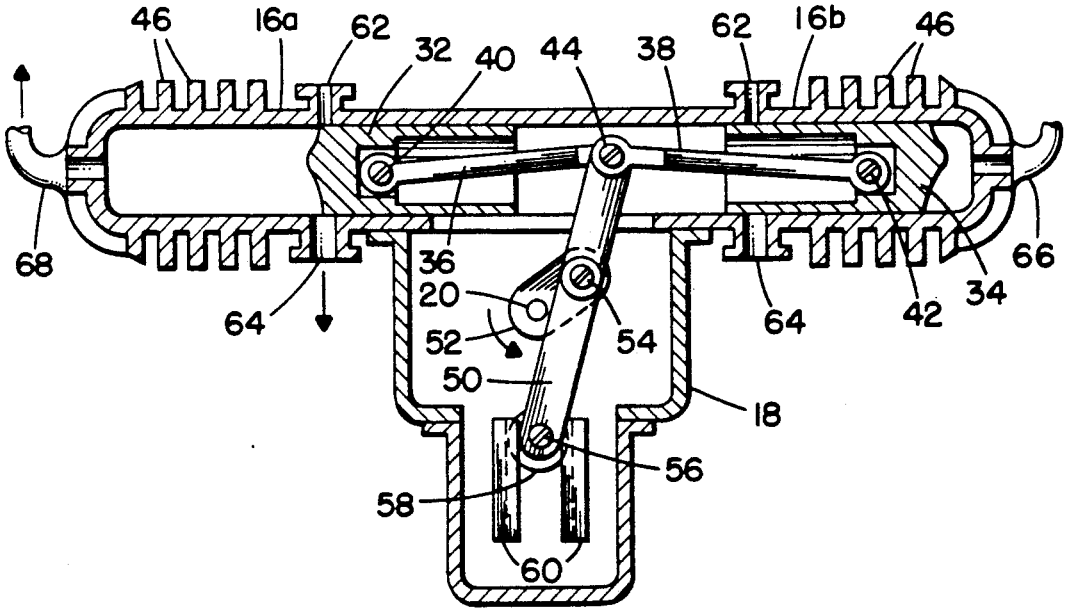
FIG. 3 is a second vertical cross-section similar to FIG. 2 showing the opposed pistons in a second position.

In FIG. 3, pistons 32 and 34 have moved leftwardly as a result of an explosion having taken place in cylinder 16*b*, driving piston 34 outwardly therefrom and compression concurrently taking place in cylinder 16*a*. By virtue of power stroke, piston rod 38 exerts a force, via cross pin 44, at the upper end o lever arm 50, causing it to rotate about the moveable fulcrum provided by disk 58 which, in turn, causes rotation of crank arm 52 to a position where it defines an angle of approximately 45° with the horizontal. This angular position of the crank arm drives the pivotal connection of piston rods 36 and 38 upwardly by a small amount from the position shown in FIG. 2 and destroys their colinearity; however, by virtue of the offset interconnection shown in FIG. 5, the piston rods remain in the same plane.

FIG. 4 shows the stage in the operation in which both pistons have moved further to the left from the position shown in FIG. 3 to an intermediate position in their respective cylinders 16*a* and 16*b*, at which lever arm 50 has been rotated about the moveable fulcrum to a vertical position and at the same time has rotated crank arm 52 of the crankshaft to a vertical position. In this stage, the upper end of lever arm 50 is at its uppermost position, causing maximum angularity between the axes of piston rods 36 and 38.

Upon continued movement of the pistons to the left the piston 32 will reach its extreme inward position in cylinder 16*a* and piston 34 will reach its outermost position in cylinder 16*b*. This is the reverse of their respective positions as shown in FIG. 2 and it will be clear, without illustration, that the outlet port 64 of cylinder 16*b* is opened first to start the exhaust of the combustion gases from that cylinder, and inlet port 62 then opens to receive a fresh charge of air from compressor 30. As previously indicated, the inrush of fresh air completes the process of exhausting the combustion gases and replaces the combustion in cylinder 16*b*. At the same time piston 32 has reached its innermost position and compresses the air in cylinder 16*a* in preparation of injection of a suitable charge of fuel. It will be appreciated that with this movement of the pistons the crank arm 52 will have been rotated clockwise by 90° so as to have a position which is the reverse of that shown in FIG. 2.

As previously noted, the crankshaft has four crank arms which are equally spaced from each other at 90° intervals, there being one crank arm for each pair of opposed cylinders. Thus, at any angular position of the crankshaft two of the eight cylinders are engaged in their respective power strokes. Accordingly, for every revolution of the crankshaft, four separate and successive power thrusts are delivered to it, each delivered by two separate and spaced power pistons situated 180° apart. This arrangement makes for a nicely balanced engine with smooth operation and a substantially continuous flow of power.

The relatively long stroke-small bore design provides a relatively high torque output at a relatively low r.p.m. The length of the piston stroke is twice the length of the crankshaft throw (diameter of the circular path described by the crank pin 54). This is effected through the use of the lever arm 50 between the piston rods of the cylinders and the crankshaft. Accordingly, the pistons apply twice the leverage upon the crankshaft which they would apply if connected directly thereto.

The long stroke-small bore design also provides an improved surface (piston area) to cylinder volume ratio which, when combined with the longer piston dwell during initial combustion states, lengthens the time before quenching begins to promote more complete combustion during the work stroke. This will be evident from FIGS. 2 through 4 from which it will be seen that the opposed pistons 32 and 34 are not always the same distance apart. When their respective piston rods are axially aligned, as in FIG. 2, the pistons are at their extreme outer positions relative to each other. When the piston rods are inclined toward each other at the smallest angle which the geometry of the system will permit, as in FIG. 4, the pistons are at their extreme inner position relative to each other.

It will also be understood that the power pistons travel toward and away from each other concurrently with their joint movement in the same direction. Thus, when the crankshaft rotates 90° from its FIG. 2 position to its FIG. 4 position, the pistons will move toward each other at the same time that they are both moving to the left. Stated differently, piston 32 will move leftwardly at a slower speed than piston 34, so that in relation to each other the two pistons will be moving toward each other.

By the same token, when the crankshaft rotates an additional 90° from its FIG. 4 position to the reverse of the position shown in FIG. 2, the pistons 32 and 34 will move away from each other concurrently with their continued joint movement leftwardly. When the crankshaft rotates a further 90° to the reverse of the position shown in FIG. 4, the pistons will move toward each other at the same time they are both moving to the right, and when the crankshaft rotates an additional 90° to its FIG. 2 position, completing a 360° revolution, the power pistons will move away from each other concurrently with their joint continued movement toward the right. As previously indicated, one of the consequences of this relationship between the pistons is that longer piston dwell is attained during initial combustion and hence more complete combustion.

Since the length of the piston stroke is twice the bore diameter, the depth and volume of the combustion chamber at the time of ignition is twice that of the conventional diesel engine in which the piston is directly connected to the crankshaft and the stroke-to-bore ratio is approximately 1:1. This increased chamber depth and volume reduce peak pressures to a point where "diesel knock", common in all conventional engines, is substantially eliminated.

While a preferred form of the invention has been illustrated and described, it will be understood that the invention encompasses extensive design modification within the scope of the appended claims. For example, although an air-cooled engine is illustrated, the invention is equally applicable to a liquid-cooled engine. Similarly, although the pistons are shown formed with a protuberance 32*a* or 34*b* for enhanced distribution of the air-fuel mixture and the more uniform combustion thereof, modifications in the design of the piston, including omission of any such protuberance, will fall within the spirit of the invention.

We claim:

1. A lever type internal combustion engine comprising, in combination:

a plurality of power cylinders arranged in side-by-side opposed pairs and disposed in a first horizontal plane, each provided with a piston and a piston rod pivotally connected at an inner end with said piston, a crankshaft supported for rotation about an axis lying in a second horizontal plane disposed in spaced parallel relationship with and below said first horizontal plane, and a lever system whereby the power cylinder pistons drive said crankshaft, said lever system, one for each pair of opposed power cylinders, comprising an elongate lever arm pivotally interconnected at a first end with the outer ends of said piston rods, means including guide members disposed below said crankshaft for constraining a second end of said lever arm for up and down movement in a direction perpendicular to said first and second horizontal planes, and means for operatively connecting said lever arm at a point intermediate its first and second ends to said crankshaft, whereby said lever arm functions as a lever of the second class between the piston rods and the crankshaft, the constrained second end thereof functioning as the fulcrum therefor.

2. A lever type internal combustion engine according to claim 1, wherein said engine further comprises:

a housing enclosing at least said crankshaft and said lever system, and wherein said guide members are mounted interiorly on said housing at a location below said crankshaft for guiding said second end of said lever arm along a linear path as said crankshaft is rotated by back and forth movement of said pistons.

3. A lever type internal combustion engine according to claim 1, wherein said power cylinders each have inlet and exhaust ports arranged to be concurrently opened momentarily by movement of the piston contained therein, and wherein said engine further comprises means including air compressor means driven by said crankshaft for continually supplying air under pressure to the inlet ports of all of said cylinders.

4. A lever type internal combustion engine according to claim 1, wherein the length of the piston stroke exceeds the diameter of the piston.

5. A lever type internal combustion engine comprising, in combination:

a plurality of power cylinders arranged in pairs with the cylinders of each pair being coaxially aligned in opposed positions, each of which is provided with a piston and a piston rod pivotally connected at an inner end with said piston, said pairs of cylinders being arranged side-by-side and disposed in a common horizontal plane, a crankshaft having a plurality of crankpins, one for each pair of opposed cylinders, supported for rotation about an axis disposed below and parallel to said common horizontal plane, a housing secured to and disposed below said cylinders and enclosing said crankshaft, and a lever system for causing said pistons to drive said crankshaft in rotation comprising a plurality of elongate lever arms, one for each pair of opposed cylinders, each pivotally interconnected at a first end with the outer ends of the piston rods of a respective pair, means including fixed guide means supported within said housing at a location below said crankshaft for guiding a second end of said lever arm along a linear path in a direction perpendicular to said common horizontal plane, and means operatively connecting said lever arm at a point intermediate its ends to a respective crankpin of said crankshaft, whereby said lever arm functions as a lever of the second class between the piston rods of an opposed pair of cylinders and the crankshaft, wherein the guided second end of the lever arm comprises a moveable fulcrum for the lever, the pivotal interconnection of the first end of the lever arm with the outer ends of the piston rods of a pair is the point at which force is applied to the lever by the piston rods, and the operative connection intermediate the ends of the lever arm is the point of applied load between the lever and the corresponding crankpin.

6. A lever type internal combustion engine according to claim 5, wherein each power cylinder has inlet and exhaust ports, wherein said engine further comprises means including compressor means driven by said crankshaft for continuously supplying compressed air to the inlet ports of all of said cylinders, and wherein said inlet and exhaust ports are arranged to be opened and closed by movement of the contained piston and to be open concurrently for a time sufficient for scavenging and recharging with air both cylinders of an opposed pair.

7. A lever type internal combustion engine according to claim 2, wherein each power cylinder has inlet and exhaust ports, and wherein said engine further comprises means including a compressor coupled to and driven in rotation by said crankshaft for continuously supplying compressed air to the inlet ports of all of said power cylinders.

8. A lever type internal combustion engine according to claim 2, wherein said guide means comprises a pair of spaced, vertically oriented guides, and wherein said lever system further comprises a disk rotatably connected to said second end of said lever arm and engaged between said vertically oriented guides.

9. A lever type internal combustion engine according to claim 5, wherein said guide means comprises a pair of spaced, vertically oriented guides, and wherein said lever system further comprises a roller mechanism affixed to said second end of said lever arm and engaged between said vertically oriented guides.

* * * * *